US006792683B1

(12) United States Patent
Nordstrom et al.

(10) Patent No.: US 6,792,683 B1
(45) Date of Patent: Sep. 21, 2004

(54) FOLDABLE AX

(76) Inventors: Judd D. Nordstrom, 4867 Hwy. 73, P.O. Box 72, Moose Lake, MN (US) 55767; Lance D. Nordstrom, 4867 Hwy. 73, P.O. Box 72, Moose Lake, MN (US) 55767

( * ) Notice: Subject to any disclaimer, the term of this patent is extended or adjusted under 35 U.S.C. 154(b) by 3 days.

(21) Appl. No.: 10/266,204

(22) Filed: Oct. 7, 2002

(51) Int. Cl.[7] ..... B26B 23/00
(52) U.S. Cl. ..... 30/308.2; 30/153; 16/110.1
(58) Field of Search ..... 30/308.2, 340, 30/153; 16/110.1, 111.1, 422, 426, 427, 429

(56) References Cited

U.S. PATENT DOCUMENTS 942,342 A * 12/1909 McNally ..... 30/308.2
1,189,005 A * 6/1916 Seely ..... 30/308.2
2,989,100 A * 6/1961 Burdis et al. ..... 30/308.2
4,106,539 A * 8/1978 Petrich ..... 30/308.2
5,771,588 A * 6/1998 Petrich ..... 30/308.2

* cited by examiner

*Primary Examiner*—Charles Goodman

(57) ABSTRACT

Foldable axes cut wood while being safely and easily transportable. The foldable ax provides the benefits of a long handled ax by consisting of four handle elements attached to a blade which unfold and lock in the in use position. The handle elements enclose the blade in the storage and transport position, thereby preventing the cutting edge of the blade from coming into contact with objects it could damage and rendering the foldable ax much more compact. A series of latching mechanisms removably secure each handle element in place in the in use position. The handle elements are hingedly attached to one another.

18 Claims, 3 Drawing Sheets

FOLDABLE AX

BACKGROUND OF THE INVENTION

1. Field of the Invention

The present invention relates to a foldable ax for use in connection with cutting wood. The foldable ax has particular utility in connection with cutting wood while being safely and easily transportable.

2. Description of the Prior Art

Foldable axes are desirable for cutting wood while being safely and easily transportable. When a person is camping, backpacking, or hiking, it is frequently desirable to gather wood for such purposes as fire building or the construction of a shelter. In general, the longer the handle of an ax, the greater the velocity of its blade when it strikes its target. The greater the blade velocity, the deeper the resulting cut, which correspondingly reduces total cutting time. However, a long handle makes transporting the ax difficult because it requires a lot of space. There is also a need to prevent the blade of the ax from coming into contact with objects it could damage. This has traditionally been accomplished by the use of a removable cover. Foldable axes address both of these problems by providing a handle which folds into a U-shape, thereby surrounding the blade. In this configuration, the blade cannot come into contact with objects it could damage, and the ax occupies substantially less space. However, upon unfolding the handle, the user is presented with the full advantages imparted by the long handle of a conventional ax.

The use of folding pack axes is known in the prior art. For example, U.S. Pat. No. 2,793,664 to Warrington, Sr. discloses a folding pack axe. However, the Warrington, Sr. '664 patent does not have a handle which folds into a U-shape, and has further drawbacks of lacking a handle which can surround three sides of the blade.

U.S. Pat. No. 1,189,005 to Seely discloses a folding ax that effectively locks the ax in operative or inoperative positions. However, the Seely '005 patent does not have a handle which folds into a U-shape, and additionally does not have a handle which can surround three sides of the blade.

Similarly, U.S. Pat. No. 1,457,930 to Nelems discloses a folding hatchet that has a hatchet blade that receives and carries a reversible digging tool. However, the Nelems '930 patent does not have a handle which folds into a U-shape, and cannot surround the blade on three sides with the handle.

In addition, U.S. Pat. No. 2,989,100 to Burdis et al. discloses a collapsible hand ax that includes a channel-shaped holder. However, the Burdis et al. '100 patent does not have four handle elements, and also does not have a handle which folds into a U-shape.

Furthermore, U.S. Pat. No. 4,106,539 to Petrich discloses a folding hatchet that has a channel member having a head member rotatably attached to one end. However, the Petrich '539 patent does not have a handle which folds into a U-shape, and further lacks four handle elements.

U.S. Pat. No. 5,771,588 to Petrich discloses a folding ax that is compact and a folding position exhibit superior strength, safety, and self lubricating characteristics when in the open or use position. However, the Petrich '539 patent does not have a handle which folds into a U-shape, and also does not have four handle elements.

Lastly, U.S. Pat. No. Des. 278,967 to Hewitt discloses a folding hatchet that has a handle resembling that of a pocketknife. However, the Hewitt '967 patent does not have a handle which folds into a U-shape, and has the additional deficiency of not being able to surround the blade on three sides with the handle.

While the above-described devices fulfill their respective, particular objectives and requirements, the aforementioned patents do not describe a foldable ax that allows cutting wood while being safely and easily transportable. The above patents make no provision for a handle which folds into a U-shape. The Burdis et al. '100 patent, the Petrich '539 patent, and the Petrich '539 patent lack four handle elements. The Warrington, Sr. '664 patent, the Seely '005 patent, the Nelems '930 patent, and the Hewitt '967 patent cannot surround the blade on three sides with the handle.

Therefore, a need exists for a new and improved foldable ax that can be used for cutting wood while being safely and easily transportable. In this regard, the present invention substantially fulfills this need. In this respect, the foldable ax according to the present invention substantially departs from the conventional concepts and designs of the prior art, and in doing so provides an apparatus primarily developed for the purpose of cutting wood while being safely and easily transportable.

SUMMARY OF THE INVENTION

In view of the foregoing disadvantages inherent in the known types of folding pack axes now present in the prior art, the present invention provides an improved foldable ax, and overcomes the above-mentioned disadvantages and drawbacks of the prior art. As such, the general purpose of the present invention, which will be described subsequently in greater detail, is to provide a new and improved foldable ax which has all the advantages of the prior art mentioned heretofore and many novel features that result in a foldable ax which is not anticipated, rendered obvious, suggested, or even implied by the prior art, either alone or in any combination thereof.

To attain this, the present invention essentially comprises a blade with a cutting edge and a base end with a first handle element connected to the base end of the blade. Three additional handle elements are connected end to end to one end of the first handle element.

There has thus been outlined, rather broadly, the more important features of the invention in order that the detailed description thereof that follows may be better understood and in order that the present contribution to the art may be better appreciated.

The invention may also include the second handle element, third handle element, and fourth handle element being hingedly attached to one another and to the first handle element. The handle elements may be foldable into a U-shape which surrounds the blade. The second, third, and fourth handle elements may each have a latching mechanism to removably secure the handle elements to each other. Each latching mechanism may consist of a latch receiver slot, a latch springedly and hingedly attached to the handle element, and a latch access cut in the top of the handle element. The blade may be made of steel, aluminum, or titanium. The handle elements may be made of plastic, aluminum, steel, titanium, or carbon fiber composite. The latches may be made of plastic, steel, aluminum, or titanium. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently current, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved foldable ax that has all of the advantages of the prior art folding pack axes and none of the disadvantages.

It is another object of the present invention to provide a new and improved foldable ax that maybe easily and efficiently manufactured and marketed.

An even further object of the present invention is to provide a new and improved foldable ax that has a low cost of manufacture with regard to both materials and labor, and which accordingly is then susceptible of low prices of sale to the consuming public, thereby making such foldable ax economically available to the buying public.

Still another object of the present invention is to provide a new foldable ax that provides in the apparatuses and methods of the prior art some of the advantages thereof, while simultaneously overcoming some of the disadvantages normally associated therewith.

Even still another object of the present invention is to provide a foldable ax for cutting wood while being safely and easily transportable. This allows the user to generate the blade velocities of a long handled ax while cutting wood.

Still yet another object of the present invention is to provide a foldable ax for cutting wood while being safely and easily transportable. This makes it possible to make the ax more compact.

An additional object of the present invention is to provide a foldable ax for cutting wood while being safely and easily transportable. This makes it possible to prevent the cutting edge of blade from coming into contact with an object it could damage.

A further object of the present invention is to provide a foldable ax for cutting wood while being safely and easily transportable. This makes it possible to securely lock the handle elements in place when the ax is in use.

Lastly, it is an object of the present invention to provide a new and improved foldable ax for cutting wood while being safely and easily transportable.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated current embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE CURRENT EMBODIMENT

Figure 1:
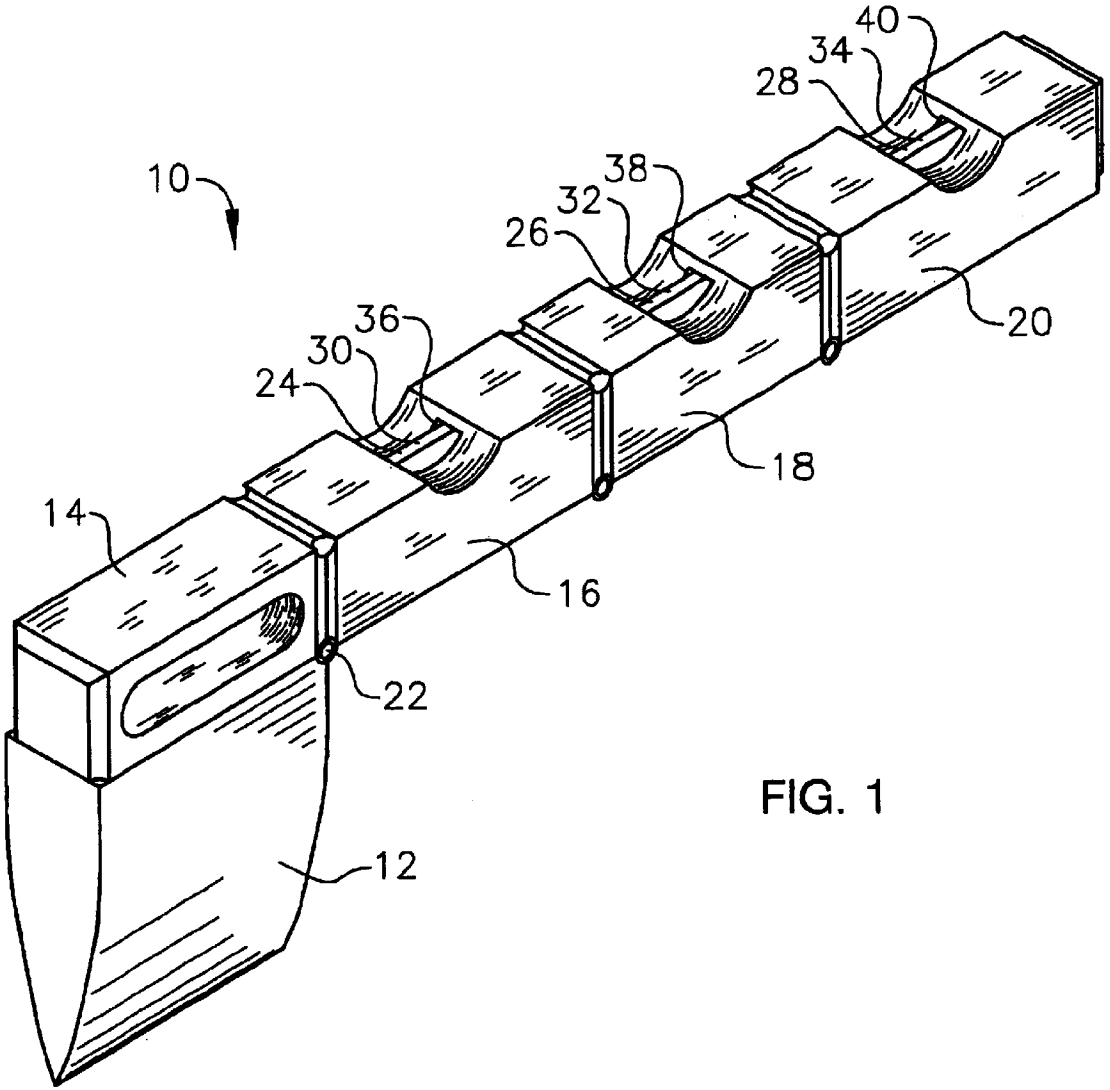
FIG. 1 is a top perspective view of the current embodiment of the foldable ax constructed in accordance with the principles of the present invention.

Referring now to the drawings, and particularly to FIGS. 1–5, a current embodiment of the foldable ax of the present invention is shown and generally designated by the reference numeral 10.

In FIG. 1, a new and improved foldable ax 10 of the present invention for cutting wood while being safely and easily transportable is illustrated and will be described. More particularly, the foldable ax 10 has a blade 12 made of steel in the current embodiment with a cutting edge and a base end. First handle element 14 is attached to the base end of blade 12. Second handle element 16 is hingedly attached by first hinge 22 to one end of first handle element 14. Third handle element 18 is shown with one end hingedly attached to the opposing end of second handle element 16. Fourth handle element 20 is shown with one end hingedly attached to the opposing end of third handle element 18. The foldable ax 10 is shown ready for use with the second handle element 16 removably locked in place to first handle element 14 by first latching mechanism 24, third handle element 18 removably locked in place to second handle element 16 by second latching mechanism 26, and fourth handle element 20 removably locked in place to third handle element 18 by third latching mechanism 28. First latching mechanism 24 has a first latch 30 accessible through first latch access 36. Second latching mechanism 26 has a second latch 32 accessible through second latch access 38. Third latching mechanism 28 has a third latch 34 accessible through third latch access 40. In the current embodiment, first handle element 14, second handle element 16, third handle element 18, and fourth handle element 20 are made of plastic. First latch 30, second latch 32, and third latch 34 are made of aluminum in the current embodiment.

Figure 2:
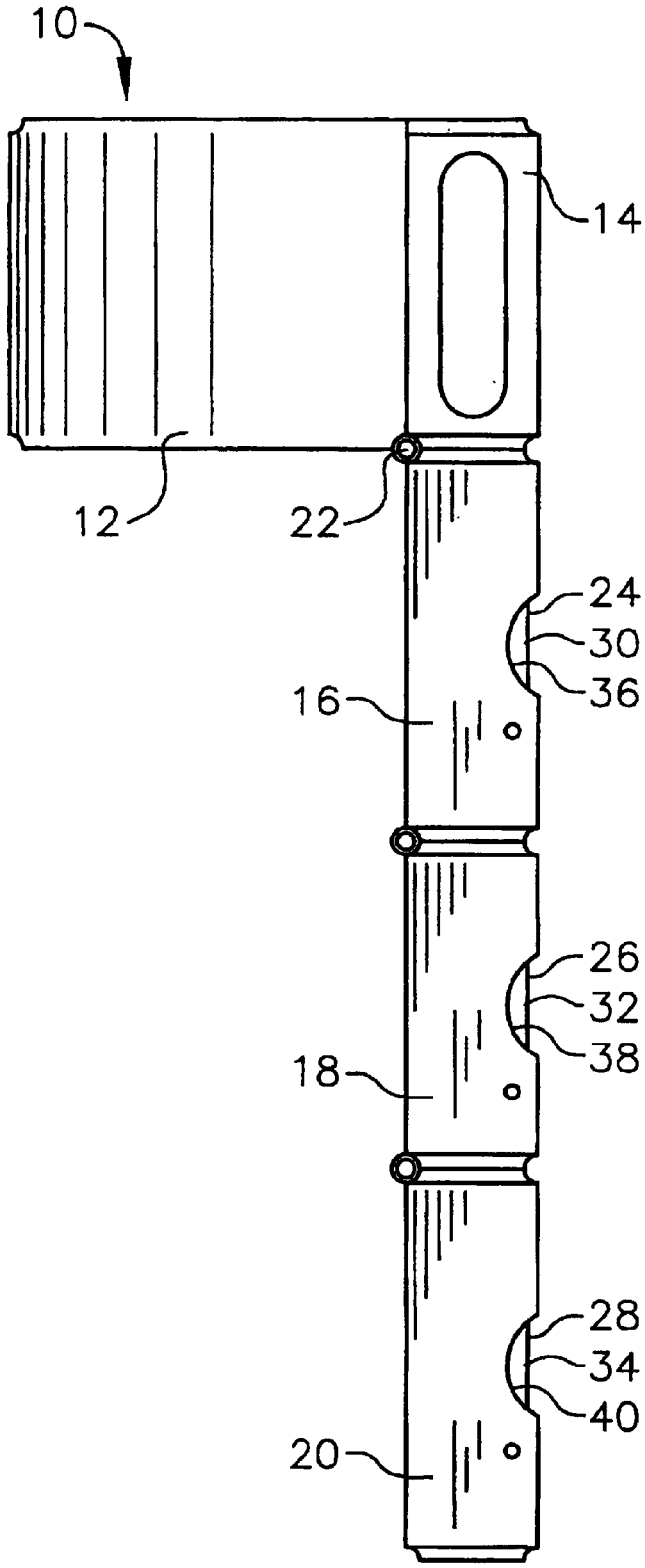
FIG. 2 is a right side view of the foldable ax of the present invention.

Moving on to FIG. 2, a new and improved foldable ax 10 of the present invention for cutting wood while being safely and easily transportable is illustrated and will be described. More particularly, the foldable ax 10 has a blade 12 attached to first handle element 14. Second handle element 16, third handle element 18, and fourth handle element 20 are shown locked in place in the in use position by first latching mechanism 24, second latching mechanism 26, and third latching mechanism 28. First hinge 22 is shown hingedly connecting first handle element 14 to second handle element 16. First latch 30 is visible through first latch access 36, second latch 32 is visible through second latch access 38, and third latch 34 is visible through third latch access 40.

Figure 3:
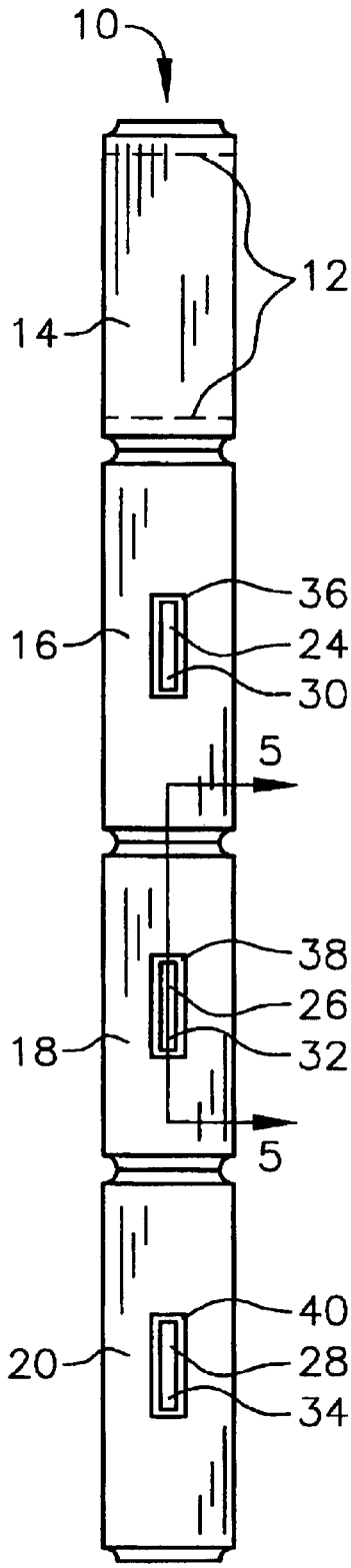
FIG. 3 is a top side view of the foldable ax of the present invention.

Continuing with FIG. 3, a new and improved foldable ax 10 of the present invention for cutting wood while being safely and easily transportable is illustrated and will be described. More particularly, the foldable ax 10 has a blade 12 denoted by broken lines attached to first handle element 14. Second handle element 16, third handle element 18, and fourth handle element 20 are shown locked in place in the in use position by first latching mechanism 24, second latching mechanism 26, and third latching mechanism 28. First latch 30 is visible through first latch access 36, second latch 32 is visible through second latch access 38, and third latch 34 is visible through third latch access 40. First hinge 22 is also shown.

Figure 4:
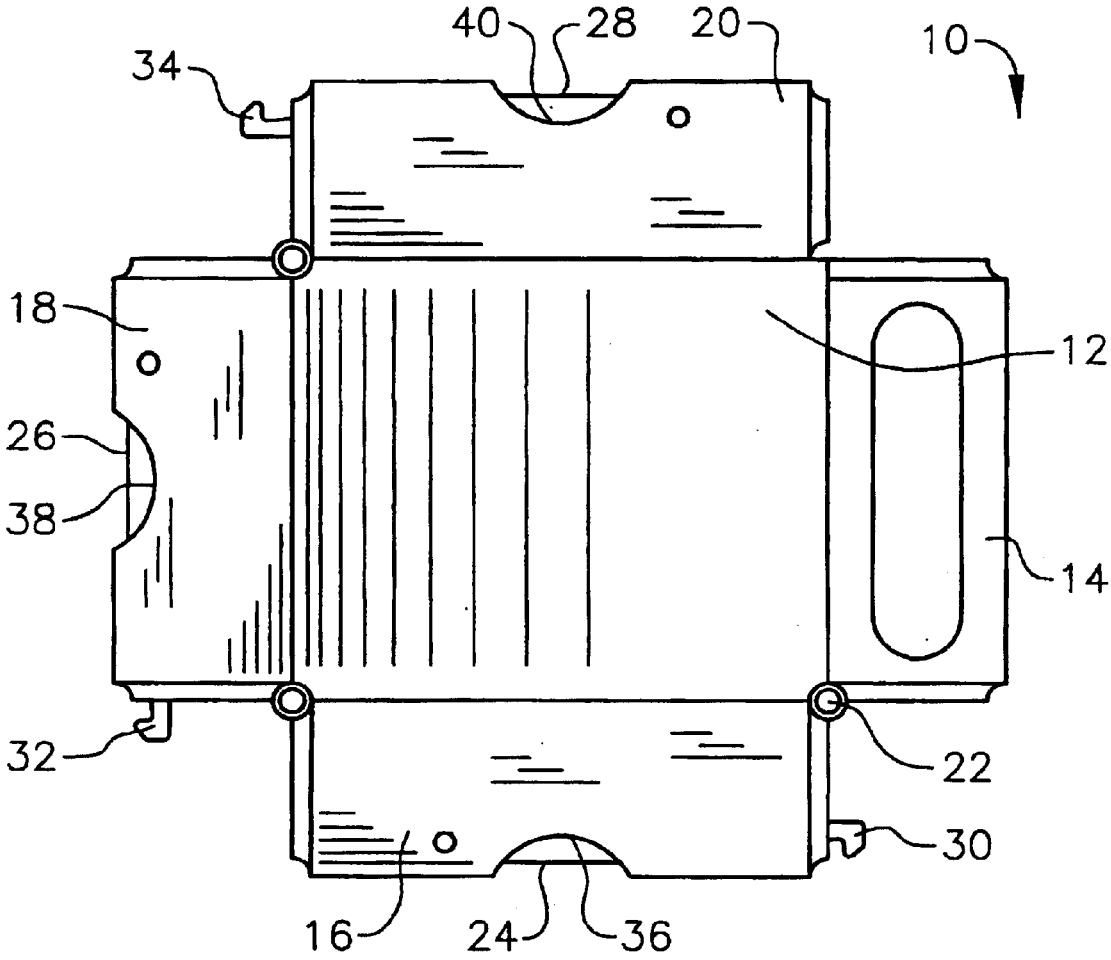
FIG. 4 is a right side view of the foldable ax of the present invention.

In FIG. 4, a new and improved foldable ax 10 of the present invention for cutting wood while being safely and easily transportable is illustrated and will be described. More particularly, the foldable ax 10 has a blade 12. The foldable ax 10 is shown in the storage and transport position with first latching mechanism 24, second latching mechanism 26, and third latching mechanism 28 in the unlocked position. Second handle element 16, third handle element 18, and fourth handle element 20 are folded about their hinged attachment points, including first hinge 22, so as to surround blade 12 by forming a U-shape. The cutting edge of blade 12 is now covered by second handle element 16, third handle element 18, and fourth handle element 20, thereby preventing the cutting edge from coming into contact with any objects it could damage. In this position, foldable ax 10 is also much more compact, thereby requiring less space during storage and transport. First latch 30, second latch 32, and third latch 34 are visible, along with first latch access 36, second latch access 38, and third latch access 40.

Figure 5:
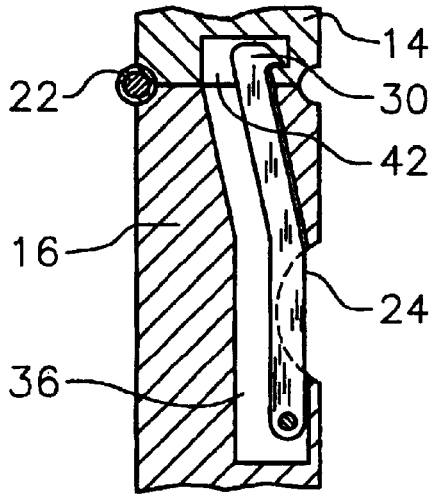
FIG. 5 is a side sectional view of the first latching mechanism of the present invention.

Concluding with FIG. 5, a new and improved first latching mechanism 24 of the present invention for cutting wood while being safely and easily transportable is illustrated and will be described. More particularly, the first latching mechanism 24 has a first latch 30 which removably engages with a first latch receiver slot 42 in one end of first handle element 14. First latch 30 is springedly hingedly attached to the top of second handle element 16 and is enclosed by first latch access 36. When second handle element 16 is rotated from its unlocked position counterclockwise about first hinge 22, first latch 30 engages with first latch receiver slot 42, thereby locking second handle element 16 into its in use position. To transport or store the foldable ax 10, first latch 30 is depressed through first latch access 36 to disengage first latch 30 from first latch receiver slot 42. At that point, second handle element 16 can be rotated in a clockwise fashion about first hinge 22 until it contacts blade 12 (not shown). Identical procedures are performed on third handle element 18 (not shown) and fourth handle element 20 (not shown) to prepare them for use and for transport or storage.

In use, it can now be understood that foldable ax 10 is stored and transported in the position illustrated in FIG. 4. When the user wishes to use foldable ax 10, the second handle element 16, third handle element 18, and fourth handle element 20 are unfolded and locked in place using the procedure described in the narrative for FIG. 5. Once the user is finished cutting wood with foldable ax 10, the second handle element 16, third handle element 18, and fourth handle element 20 are unlocked and folded around blade 12 following the procedure described in the narrative for FIG. 5. At that point, the foldable ax 10 is again ready for storage and/or transport with the cutting edge safely surrounded by second handle element 16, third handle element 18, and fourth handle element 20.

While a current embodiment of the foldable ax has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as steel, aluminum, titanium, or carbon fiber composite may be used instead of the plastic first handle element, second handle element, third handle element, and fourth handle element described. Also, the steel blade may also be made of aluminum or titanium. Furthermore, plastic, steel, or titanium may be used instead of the aluminum first latch, second latch, and third latch described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A foldable ax comprising:

a blade having a base end, opposing sides, and a cutting end;

a first handle element having opposing ends, a top, and a bottom with said bottom attached to said base end of said blade;

a second handle element having opposing ends and a top with one of said opposing ends attached to one of said opposing end of said first handle element;

a third handle element having opposing ends and a top with one of said opposing ends attached to said other opposing end of said second handle element; and fourth handle element having opposing ends and a top with one of said opposing end attached to said other opposing end of said third handle element, wherein said first handle element, said second handle element, said third handle element, and said fourth handle element are hingedly attached to one another and can be folded to respectively cover said base end, said opposing sides, and said cutting end of said blade.

2. The foldable ax as defined in claim 1, further comprising:

a first latching mechanism removably securing said second handle element to said first handle element;

a second latching mechanism removably securing said third handle element to said second handle element; and a third latching mechanism removably securing said fourth handle element to said third handle element.

3. The foldable ax as defined in claim 2, wherein said first latching mechanism comprises:

a first latch receiver slot wherein said opposing end of said first handle element defines a slot therein to comprise said first latch receiver slot;

a first latch access wherein said top of said second handle element defines a hole therein to comprise said first latch access; and a first latch hingedly attached to said top of said second handle element.

4. The foldable ax as defined in claim 2, wherein said second latching mechanism comprises:

a second latch receiver slot wherein said opposing end of said second handle element defines a slot therein to comprise said second latch receiver slot;

a second latch access wherein said top of said third handle element defines a hole therein to comprise said second latch access; and a second latch hingedly attached to said top of said third handle element.

5. The foldable ax as defined in claim 2, wherein said third latching mechanism comprises:

a third latch receiver slot wherein said opposing end of said third handle element defines a slot therein to comprise said third latch receiver slot;

a third latch access wherein said top of said fourth handle element defines a hole therein to comprise said third latch access; and a third latch hingedly attached to said top of said fourth handle element.

6. The foldable ax as defined in claim 1, wherein said blade is selected from the group consisting of steel, aluminum, and titanium.

7. The foldable ax as defined in claim 1, wherein said first handle element, said second handle element, said third handle element, and said fourth handle element are selected from the group consisting of plastic, aluminum, steel, titanium, and carbon fiber composite.

8. A foldable ax comprising:

a blade having a base end, opposing sides, and a cutting end; and a plurality of handle elements having opposing ends wherein said ends of said handle elements are hingedly attached to one another, at least one handle element is attached to said base end of said blade, and said handle elements can be folded elements respectively cover said base end, said opposing sides, and said cutting end of said blade.

9. The foldable ax as defined in claim 8, further comprising a plurality of latching mechanisms enclosed by said handle elements.

10. The foldable ax as defined in claim 9, wherein said latching mechanisms comprise:

a latch receiver slot wherein said opposing ends of said handle elements define a slot therein to comprise said latch receiver slot;

a latch access wherein said tops of said handle elements.

11. The foldable ax as defined in claim 10, wherein said latch is springedly hingedly attached to said top of said handle elements.

12. The foldable ax as defined in claim 10, wherein said latch is selected from the group consisting of plastic, aluminum, steel, and titanium.

13. A foldable ax comprising:

a handle having a plurality of sections which can be folded into a U-shape; and a blade having a base end, opposing sides, and a cutting end with said base end attached to said handle, wherein said handle sections respectively cover said base end, said opposing sides, and said cutting end of said blade when said handle is folded into a U-shape.

14. The foldable ax as defined in claim 13, further comprising a first hinge connecting said blade to said handle.

15. The foldable ax as defined in claim 13, wherein said handle sections comprise a hollow first handle element having opposing ends with one end hingedly attached to said blade;

a hollow second handle element having opposing ends with one end hingedly attached to said opposing end of said first handle element; and a hollow third handle element having opposing ends with one end hingedly attached to said opposing end of said second handle element.

16. The foldable ax as defined in claim 15, further comprising a plurality of latching mechanisms enclosed by said first handle element, said second handle element, and said third handle element.

17. The foldable ax as defined in claim 16, wherein said latching mechanisms comprise:

latch receiver slots wherein said opposing ends of said first handle element, said second handle element, and said third handle element defined a slot therein to comprise said latch receiver slots; and latches enclosed by said first handle element, said second handle element, and said third handle element.

18. The foldable ax as defined in claim 17, wherein said latches are springedly hingedly attached to said first handle element, said second handle element, and said third handle element.

* * * * *